US007495564B2

(12) United States Patent
Harold et al.

(10) Patent No.: US 7,495,564 B2
(45) Date of Patent: Feb. 24, 2009

(54) SYSTEMS AND METHODS FOR DATA READING AND EAS TAG SENSING AND DEACTIVATING AT RETAIL CHECKOUT

(75) Inventors: Clifford C. Harold, Eugene, OR (US); Douglas Allen Drew, Boca Raton, FL (US); Alan Jackson Guess, Eugene, OR (US); Robert F. Kortt, Eugene, OR (US); Bruce E. Paris, Eugene, OR (US); Nicolas N. Tabet, Eugene, OR (US)

(73) Assignees: Datalogic Scanning, Inc., Eugene, OR (US); Sensormatic Electronics Corporation, Boca Raton, FL (US)

( * ) Notice: Subject to any disclaimer, the term of this patent is extended or adjusted under 35 U.S.C. 154(b) by 3 days.

(21) Appl. No.: 11/699,207

(22) Filed: Jan. 26, 2007

(65) Prior Publication Data

US 2007/0210922 A1 Sep. 13, 2007

Related U.S. Application Data

(63) Continuation of application No. 11/127,497, filed on May 11, 2005, now Pat. No. 7,170,414, which is a continuation of application No. 10/356,384, filed on Jan. 31, 2003, now Pat. No. 7,132,947.

(60) Provisional application No. 60/443,421, filed on Jan. 28, 2003, provisional application No. 60/353,139, filed on Feb. 1, 2002.

(51) Int. Cl.
*G08B 13/14* (2006.01)

(52) U.S. Cl. ..... 340/572.3; 340/568.1; 340/571; 340/572.4; 235/436; 235/462.01; 235/462.25; 235/462.32

(58) Field of Classification Search ..... 340/572.3, 340/572.1, 572.4, 572.8, 568.1, 571; 235/462.01, 235/462.32, 462.25, 462.43, 462.45, 462.49, 235/436

See application file for complete search history.

(56) References Cited

U.S. PATENT DOCUMENTS 4,141,078 A 2/1979 Bridges, Jr. et al. ..... 364/900

(Continued)

FOREIGN PATENT DOCUMENTS

DE 19908880 9/2000

(Continued)

OTHER PUBLICATIONS

Brochure: Mettler Toledo 8217AS Adaptive Scale (1996).
Spectra-Physics VS1000 and VS1200 Scanner Level 1 Service Manual, pp. 4-31 through 4-32 (Dec. 1994).

(Continued)

*Primary Examiner*—Toan N Pham
(74) *Attorney, Agent, or Firm*—Stoel Rives LLP

(57) ABSTRACT

Methods of operation of a data reader and security tag deactivation system whereby a data reader such as a barcode scanner is equipped with EAS deactivation coils or modules disposed in the vicinity of the read volume or generally proximate thereto and the system is operable to permit reading of the ID tag (such as the barcode label) on an item, and upon a successful read, the deactivation unit is operable to (1) sense the presence of an EAS tag; (2) if presence of an EAS tag is sensed, energize the deactivation coil/module to deactivate the EAS tag; and (3) sense if the EAS tag is deactivated. If the EAS tag is sensed to have been deactivated, the system signals as such and a next item may be scanned. If the EAS tag is sensed to have not been deactivated, the system proceeds to alternate operational steps to handle the exception. In another function, the system is operable to urge the operator to return the item to the read volume to enhance EAS tag deactivation, one method being by delaying a good read acknowledgment until the system determines that the EAS tag which may have been previously detected has subsequently been deactivated.

22 Claims, 12 Drawing Sheets

U.S. PATENT DOCUMENTS

| | | | | |
|---|---|---|---|---|
| 4,575,624 | A | 3/1986 | Klinkhardt | 235/449 |
| 4,652,863 | A | 3/1987 | Hultman | 340/551 |
| 4,728,938 | A | 3/1988 | Kaltner | 340/572 |
| 4,745,401 | A | 5/1988 | Montean | 340/572 |
| 4,752,758 | A | 6/1988 | Heltemes | 335/284 |
| 4,960,651 | A | 10/1990 | Pettigrew et al. | 428/607 |
| 4,964,053 | A | 10/1990 | Humble | 705/416 |
| 5,059,951 | A | 10/1991 | Kaltner | 340/572 |
| 5,103,235 | A | 4/1992 | Clemens | 343/742 |
| 5,139,100 | A | 8/1992 | Brauneis | 177/25.15 |
| 5,142,292 | A | 8/1992 | Chang | 343/742 |
| 5,210,524 | A | 5/1993 | Schwarz et al. | 340/551 |
| 5,225,807 | A | 7/1993 | Zhou et al. | 340/551 |
| 5,341,125 | A | 8/1994 | Plonsky et al. | 340/572 |
| 5,376,923 | A | 12/1994 | Kindschy | 340/572 |
| 5,377,269 | A | 12/1994 | Heptig et al. | 380/25 |
| 5,410,108 | A | 4/1995 | Williams et al. | |
| 5,587,703 | A | 12/1996 | Dumont | 340/572 |
| 5,588,621 | A | 12/1996 | Collins et al. | 248/27.1 |
| 5,635,906 | A | 6/1997 | Joseph | 340/572 |
| 5,747,744 | A | 5/1998 | Kraft et al. | 177/25.15 |
| 5,837,988 | A | 11/1998 | Bobba et al. | 235/467 |
| 5,841,348 | A | 11/1998 | Herzer | 340/551 |
| 5,886,336 | A | 3/1999 | Tang et al. | 235/462.43 |
| 5,917,412 | A | 6/1999 | Martin | 340/572.3 |
| 5,939,984 | A | 8/1999 | Brady et al. | 340/572.1 |
| 5,955,951 | A | 9/1999 | Wischerop et al. | 340/572.8 |
| 5,963,134 | A | 10/1999 | Bowers et al. | 340/572.1 |
| 5,978,772 | A | 11/1999 | Mold | 705/16 |
| 5,984,182 | A | 11/1999 | Murrah | |
| 5,990,794 | A | 11/1999 | Alicot et al. | 340/573.1 |
| 6,025,780 | A | 2/2000 | Bowers et al. | 340/572.3 |
| 6,102,290 | A | 8/2000 | Swartz et al. | 235/462.01 |
| 6,114,961 | A | 9/2000 | Denholm et al. | 340/572.3 |
| 6,121,878 | A | 9/2000 | Brady et al. | 340/572.1 |
| 6,154,135 | A | 11/2000 | Kane et al. | 340/572.3 |
| 6,154,137 | A | 11/2000 | Goff et al. | 340/572.4 |
| 6,169,483 | B1 | 1/2001 | Ghaffari et al. | 340/572.3 |
| 6,206,285 | B1 | 3/2001 | Baitz et al. | 235/380 |
| 6,208,235 | B1 | 3/2001 | Trontelj | 340/10.1 |
| 6,234,394 | B1 | 5/2001 | Kahn et al. | 235/462.46 |
| 6,237,852 | B1 | 5/2001 | Svetal et al. | 235/462.43 |
| 6,252,508 | B1 | 6/2001 | Vega et al. | 340/572.1 |
| 6,281,796 | B1 | 8/2001 | Canipe et al. | 340/572.3 |
| 6,299,702 | B1 | 10/2001 | Herzer | 148/108 |
| 6,333,692 | B1 | 12/2001 | Andersen et al. | 340/572.1 |
| 6,335,686 | B1 | 1/2002 | Goff et al. | 340/572.4 |
| 6,346,884 | B1 | 2/2002 | Uozumi et al. | 340/572.1 |
| 6,356,197 | B1 | 3/2002 | Patterson et al. | 340/572.1 |
| 6,429,776 | B1 | 8/2002 | Alicot et al. | 340/572.1 |
| 6,497,361 | B1 | 12/2002 | Mason | 235/383 |
| 6,499,656 | B1 | 12/2002 | Marsh et al. | 235/375 |
| 6,507,279 | B2 | 1/2003 | Loof | 340/572.1 |
| 6,517,000 | B1 | 2/2003 | McAllister et al. | 235/462.01 |
| 6,592,037 | B1 | 7/2003 | Clancy | 235/462.13 |
| 6,595,421 | B2 | 7/2003 | Detwiler | 235/462.14 |
| 6,681,989 | B2 | 1/2004 | Bodin | 705/16 |
| 6,674,010 | B2 | 7/2004 | Collins, Jr. et al. | 235/383 |
| 6,764,010 | B2 | 7/2004 | Collins | 235/462.11 |
| 6,783,072 | B2 | 8/2004 | Acosta et al. | 235/454 |
| 6,788,205 | B1 | 9/2004 | Mason et al. | 340/572.3 |
| 6,809,645 | B1 | 10/2004 | Mason | 340/572.1 |
| 6,854,647 | B2 | 2/2005 | Collins, Jr. et al. | 235/383 |
| 7,042,359 | B2 * | 5/2006 | Clucas | 340/572.1 |
| 7,109,866 | B2 * | 9/2006 | Maitin et al. | 340/572.3 |
| 7,172,123 | B2 | 2/2007 | Acosta et al. | 235/462.13 |
| 2002/0011933 | A1 | 1/2002 | Andersen et al. | 340/572.1 |
| 2003/0075602 | A1 | 4/2003 | Wike, Jr. et al. | 235/383 |
| 2003/0209600 | A1 | 11/2003 | Collins, Jr. et al. | 235/383 |
| 2004/0000591 | A1 | 1/2004 | Collins, Jr. et al. | 235/383 |
| 2004/0113791 | A1 * | 6/2004 | Salim et al. | 340/572.3 |
| 2004/0189472 | A1 | 9/2004 | Acosta et al. | 340/572.3 |
| 2005/0145694 | A1 | 7/2005 | Collins, Jr. et al. | 235/383 |
| 2006/0208994 | A1 | 9/2006 | Friend et al. | 340/572.3 |
| 2007/0063045 | A1 | 3/2007 | Acosta et al. | 235/462.13 |

FOREIGN PATENT DOCUMENTS

| | | | |
|---|---|---|---|
| EP | 0 329 402 | B1 | 12/1994 |
| EP | 0 994 447 | A2 | 4/2000 |
| EP | 1 098 276 | A2 | 5/2001 |
| EP | 1 335 336 | A2 | 8/2003 |
| JP | 11154012 | | 6/1999 |
| WO | WO 85/02285 | | 5/1985 |
| WO | WO 00/26880 | | 5/2000 |
| WO | WO 00/67193 | | 11/2000 |

OTHER PUBLICATIONS

Brochure: PSC Inc. Magellan SL™ 360-Degree Scanner/Scale (2000).

PSC Inc. Magellan SL Scanner and Scanner/Scale Installation and Operation Manual, pp. 1-3 through 1-6 and 2-23 through 2-26 (2001).

Brochure: Sensormatic ScanMax™/SlimPad™ Electronic Article Surveillance Deactivator, Sensormatic Electronics Corporation (Jul. 1999).

Brochure: Sensormatic SlimPad™ Pro Ultra-Max™ Label Deactivator, Sensormatic Electronics Corporation (2002) Downloaded from http://www.sensormatic.com/EAS/deactivation/slimpad.asp, visited Jul. 29, 2003.

Brochure: Sensormatic ScanMax™ HS Pro Ultra-Max® Scanner-Embedded Label Deactivator, Sensormatic Electronics Corporation (2002).

Brochure: Mettler Toledo 8217AS Scanner Scale (2003) downloaded from http://www.mt.com/mt/product_detail/product.jsp?m=t&key=Y3MDg4NjMlMj visited Aug. 28, 2003.

Installation Guide for Sensormatic Acousto-Link™ Option for Ultra-Max Deactivators, Sensormatic Electronics Corporation (2000).

Sensormatic 2001 Product Catalog, pp. 117-119, 139-145, Sensormatic Electronics Corporation (2001).

Transponder News, Aug. 14, 2003, http://www.rapidttp.com/transponder/index.html, visited Aug. 20, 2003.

* cited by examiner

300
BARCODE SCANNER - EXCEPTION 1
A FROM FIG. 5
310
ALERT OPERATOR
312
WAIT FOR EXCEPTION OVERRIDE
313
START OVERRIDE PERIOD TIMER
314
IS OVERRIDE ASSERTED?
NO
YES
316
ASSERT DEACTIVATION SIGNAL TO EAS CONTROLLER
318
ARM
EAS ARMING CIRCUIT

SYSTEMS AND METHODS FOR DATA READING AND EAS TAG SENSING AND DEACTIVATING AT RETAIL CHECKOUT

This application is a continuation of application Ser. No. 11/127,497 filed May 11, 2005, U.S. Pat. No. 7,170,414, which is a continuation of application Ser. No. 10/356,384 filed Jan. 31, 2003, U.S. Pat. No. 7,132,947 which claims priority both to provisional application Ser. No. 60/353,139 filed Feb. 1, 2002 and to provisional application Ser. No. 60/443,421 filed Jan. 28, 2003.

BACKGROUND

The field of the present invention relates to data reading systems and electronic article security (EAS) systems. In particular, a method and apparatus are described herein for controlling and operating a checkout system including both a data reading system such as a barcode scanner and an EAS system.

In both retail checkout and inventory control environments, items are typically provided with readable ID tags. These ID tags may comprise optical labels such as barcode labels or electronic tags such as RFID tags. Data reading devices such as barcode scanners and RFID readers are provided at the checkout station to read the ID tags and obtain the data contained therein. The data may be used to identify the article, its price, and/or other characteristics or information related to checkout or inventory control. These data readers automate the information retrieval to facilitate and speed the checkout process. Thus data readers such as barcode scanners are pervasive at retail checkout.

Scanners generally come in three types: (a) handheld, such as the PowerScan™ scanner, (b) fixed and installed in the countertop such as the Magellan® scanner, or (c) a hybrid scanner such as the Duet® scanner usable in either a handheld or fixed mode. Each of these scanners is manufactured by PSC Inc. of Eugene, Oreg. In a typical retail checkout operation, checkout clerk uses either a handheld scanner to read the barcode symbols on the articles one at a time or passes the articles through the scan field of the fixed scanner one at a time. The clerk then places the articles into a shopping bag or other suitable container.

Though barcodes provide for rapid and accurate item identification at checkout, the barcodes do not provide for item security against theft. Electronic article surveillance (EAS) systems have employed either reusable EAS tags or disposable EAS tags to monitor articles to prevent shoplifting and unauthorized removal of articles from store. Reusable EAS tags are normally removed from the articles before the customer exits the store. Disposable EAS tags are generally attached to the packaging by adhesive or are disposed inside item packaging. These tags remain with the articles and must be deactivated before they are removed from the store by the customer.

EAS tags are generally classified into two categories: so-called "hard" tags which can be sensed but not deactivated and so-called "soft" tags which can be sensed and deactivated. Hard tags are tags such as attached to clothing which must be removed by the store clerk using a special tool at the store checkout. Soft tags since they can be deactivated need not be removed. Certain types of soft EAS tags are reactivatable which is useful in applications such as library books and video rentals.

One type of EAS tag comprises a length of amorphous magnetic material which is positioned substantially parallel to a length of magnetizable material used as a control element. When an active tag, i.e., one having a magnetized control element, is placed in an alternating magnetic field, which defines an interrogation zone, the tag produces a detectable valid tag signal. When the tag is deactivated by demagnetizing its control element, the tag no longer produces the detectable tag signal and the tag is no longer responsive to the incident energy of the EAS system so that an alarm is not triggered.

Such deactivation of the tag, can occur, for example, when a checkout operator in a retail establishment passes an EAS tagged article over a deactivation device located at the checkout counter thereby deactivating the tag.

Generally, deactivation devices of tags include a coil structure energizable to generate a magnetic field of a magnitude sufficient to render the tag "inactive." In other words, the tag is no longer responsive to incident energy applied thereto to provide an output alarm or to transmit an alarm condition to an alarm unit external to the tag.

Examples of deactivation devices include those sold under the trademarks Speed Station® and Rapid Pad® available from Sensormatic Electronics Corporation of Boca Raton, Fla. The Rapid Pad® deactivator, which generates a magnetic field when a tag is detected, has a single or planar coil disposed horizontally within a housing. Deactivation occurs when the tag is detected moving horizontally across in a coplanar disposition and within a four inch proximity of the top surface of the housing located on top of a check-out counter. The Speed Station® deactivator has a housing with six coils orthogonally positioned therein to form a "bucket-like" configuration. The operator inserts an article or plurality of articles into the open side of the bucket. The operator then deactivates the inserted articles by manually triggering the deactivator.

U.S. Pat. No. 5,917,412 discloses an EAS tag deactivation device including a deactivating coil having first and second coil parts. The first coil part is positioned in angular adjacent relation to the second coil part so that the coil parts are adapted to transmit simultaneously a deactivating field. The deactivating field forms a deactivation zone having a configuration which permits for deactivation of an active EAS tag when the active EAS tag is situated within the deactivation zone.

There have been attempts to integrate the structure of a barcode scanner with an EAS deactivation system. In one system, an EAS deactivation coil is disposed around the horizontal scan window of a two-window "L" shaped scanner such as the Magellan® scanner. In such a system, barcode scanning and EAS tag deactivation are accomplished generally within the same volume. The deactivation either takes place at the same time as the scanning, or the deactivation may be controlled to activate after a successful barcode read.

Deactivation of a tag attached to an article is sometimes ineffective for various reasons. This failure to deactivate can result in false alarming of the EAS system which is undesirable. The present inventors have recognized the need for enhanced operation protocols for controlling operation of the scanner and deactivation unit to allow for handling of various operation scenarios, particularly where the EAS deactivation system is integrated within the scanner housing.

SUMMARY

The present invention is directed to systems for and methods of operation of a data reader and security tag deactivation system. In a first preferred configuration, a data reader such as a barcode scanner is equipped with EAS deactivation coils or modules disposed in the vicinity of the read volume or generally proximate thereto and the system is operable to permit reading of the ID tag (such as the barcode label) on an item, and upon a successful read, the deactivation unit is operable to (1) sense the presence of an EAS tag; (2) if presence of an EAS tag is sensed, energize the deactivation coil/module to deactivate the EAS tag; and (3) sense if the EAS tag is deactivated. If the EAS tag is sensed to have been deactivated, the system signals as such and a next item may be scanned. If the EAS tag is sensed to have not been deactivated, the system proceeds to alternate operational steps to handle the exception.

In another function, the system may operate to enhance EAS tag deactivation by urging the operator to return the item to the read volume such as by delaying a good read acknowledgment, usually signified by an audible "beep" until the system determines that the EAS tag which may have been previously detected has subsequently been deactivated.

DETAILED DESCRIPTION OF THE PREFERRED EMBODIMENTS

Figure 1:
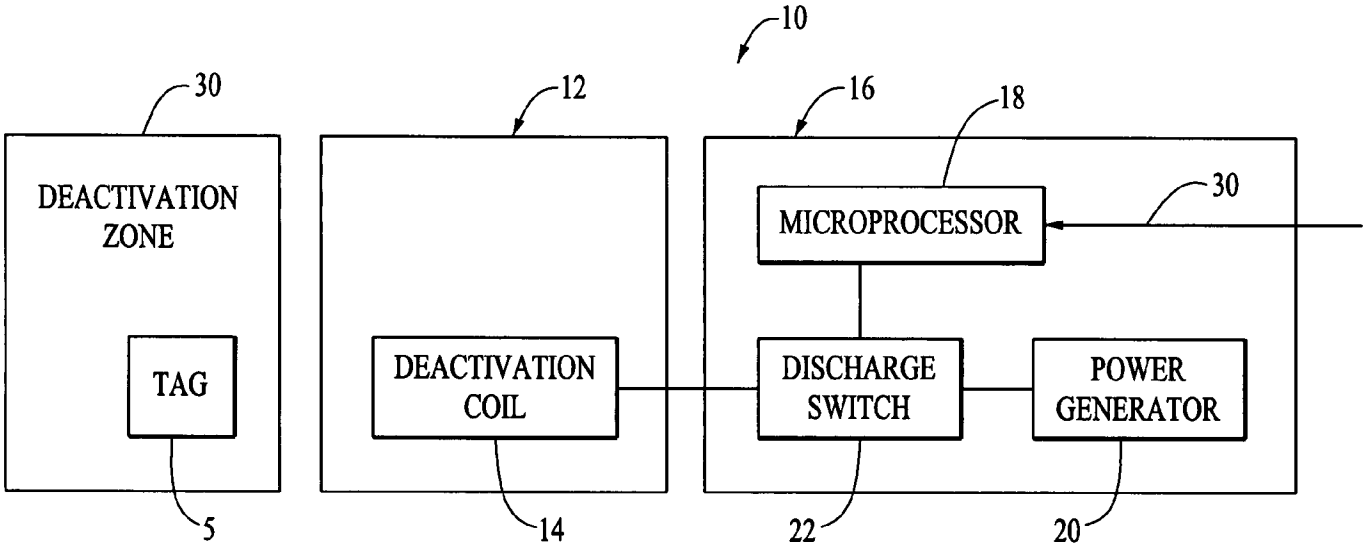
FIG. 1 is a block diagram of an EAS deactivation system.
Figure 2:
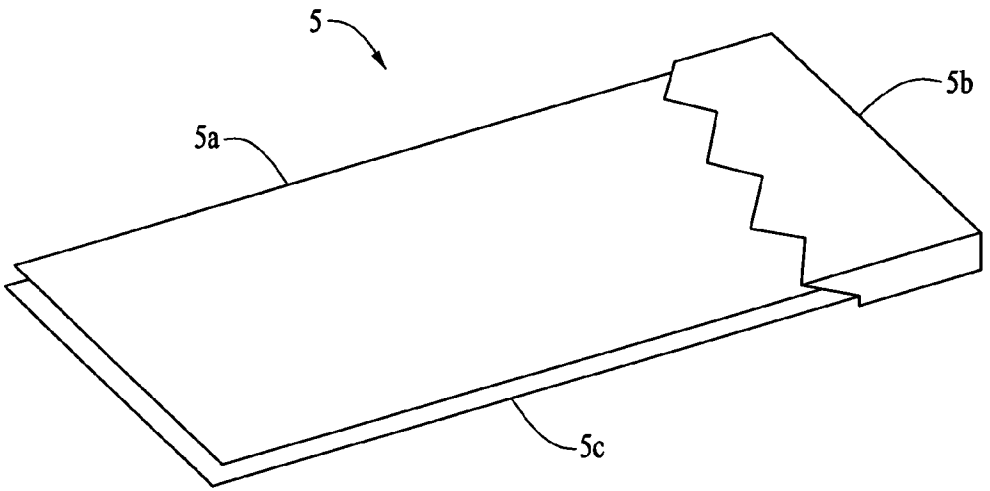
FIG. 2 shows an example EAS tag for use with the deactivation system(s) and methods disclosed herein.

Preferred embodiments of the present invention will now be described with reference to the drawings. To facilitate description, any reference numeral representing an element in one figure will represent the same element in any other figure.

A deactivation device 10 as illustrated in FIG. 1 is used for deactivating active EAS tags used in an EAS system. The device 10 defines a deactivation zone 30 in which an EAS tag 5 can be deactivated. The deactivation device 10 comprises a deactivator unit 12 and an energizing or power source unit 16. The deactivator unit 12 comprises one or more deactivating coils 14. The one or more deactivating coil(s) 14 may be positioned at a variety of different angles and positions depending on the shape of the deactivation zone desired to be formed by the deactivation device 10.

The coil(s) are adapted to transmit magnetic fields for altering the magnetic properties of an active EAS tag placed in proximity to the coil(s) 14. The power source unit 16 controls the operation of the deactivation unit 12 in terms of energizing the deactivating coil(s) 14. The power source unit 16 is connected to the unit 12 by a cable 24 and comprises a power generator 20 and a discharge switch 22 controlled via signal from a microprocessor 18.

Figure 3:
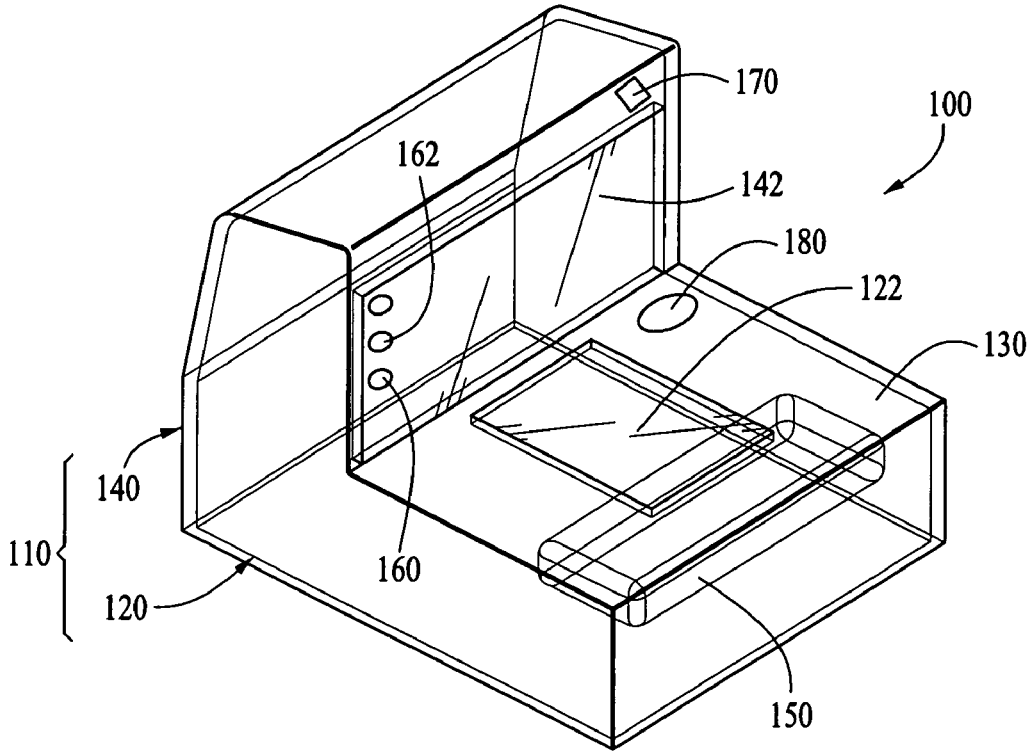
FIG. 3 is a perspective view of a combined data reader and EAS system according to an example embodiment with a deactivation unit disposed longitudinally at the proximal end of the horizontal section distal from the vertical section.

The system is applicable to any type of EAS tags such as magnetoacoustic, magnetomechanical, magnetostrictive, RF (e.g. RFID tag), microwave, and harmonic type tags. One example tag 5 is illustrated in FIG. 3 comprising a magnetostrictive amorphous element 5*a* contained in an elongated housing 9*b* in proximity to a control element 5*c* which can be comprised of a biasing magnetizable material. Tags of this type are available from Sensormatic Electronics Corporation of Boca Raton, Fla. under the trademark Ultra*Max®. The characteristics and operation of tags like the deactivatable tag 5 is further described in U.S. Pat. No. 4,510,489 which is hereby incorporated by reference.

During operation of the deactivation device 10, a microprocessor 18 receives an input signal over input line 40 indicating that a tag is present at the deactivation device for deactivation. The signal can be generated in a similar fashion as in prior art deactivators, such as the deactivator described in U.S. Pat. No. 5,341,125, hereby incorporated by reference. Such deactivators include transmit/receive coils and associated processing circuitry (not shown) for detecting the presence of a tag in the deactivation zone 30 and furnishing the signal over line 40.

Upon receipt of the signal on line 40, the microprocessor 18 initiates a deactivating sequence for the deactivation device 10 by closing a discharge switch 22 that allows the output of a power generator 20 to be connected to the deactivating coil(s) 14. A current then flows in the first and second deactivating coil(s) 14 causing deactivating electromagnetic fields to be transmitted by the coil(s) 14 and a resultant deactivation field is formed in the deactivation zone 30. The resultant deactivation field establishes flux lines along the length of the magnetizable control element 5*c* of the tag 5, thereby demagnetizing the element.

Figure 4:
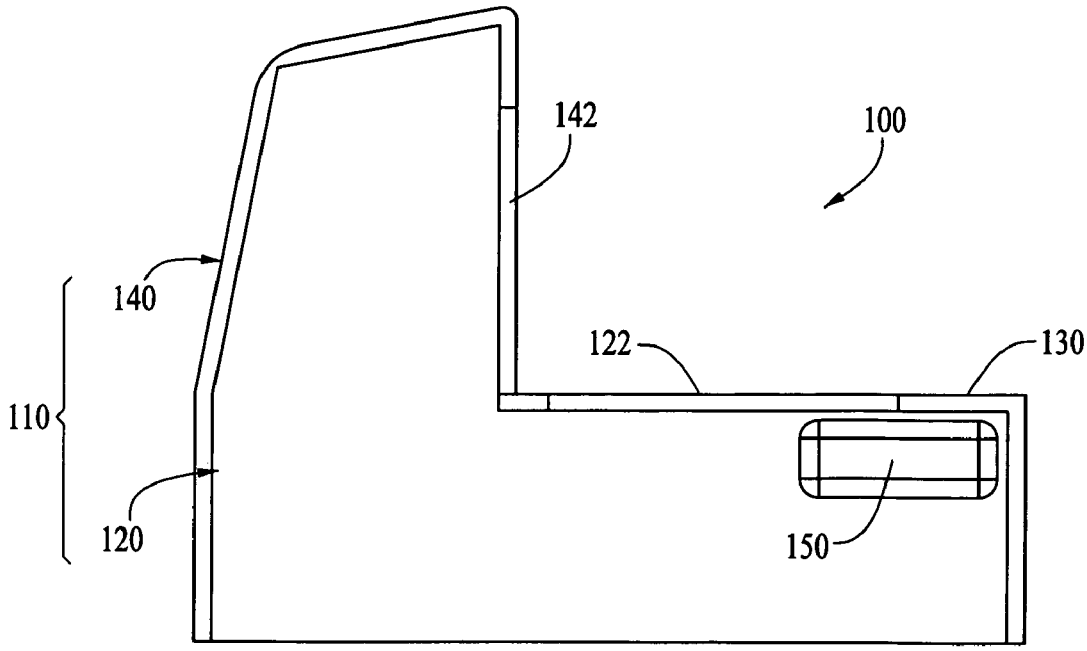
FIG. 4 is a left side plan view of FIG. 3.

Though the system and operational methods described herein are applicable to any suitable type of data reader and deactivation system, they are particularly applicable to integrated configurations. Various configurations for integrated data reader and EAS deactivation systems are disclosed in U.S. application Ser. No. 10/062,274 filed Feb. 1, 2002 U.S. Pat No. 6,783,072 entitled "COMBINED DATA READER AND ELECTRONIC ARTICLE SURVEILLANCE (EAS) SYSTEM" hereby incorporated by reference. FIGS. 3-4 herein illustrate one configuration for a combined EAS and barcode reader 100. The data reader 110 is illustrated as an L-shaped scanner with a lower section 120 containing a horizontal scan window 122 disposed in the horizontal surface or weigh platter 130, and an upper section 140 containing a vertical scan window 142.

In the embodiment of FIGS. 3-4, the deactivation unit 150 is disposed longitudinally along the scan direction of item sweep, in the lower housing section 120 distal from the upper housing section 140 and next to the operator (also known as "checker side"). Alternately, the deactivation unit 150 may be disposed on a lateral side of the window 122 downstream of the direction of scanning, for example, on the left side when the scanner is operated in a right-to-left scanning direction. In either configuration, or some other suitable configuration, the deactivation coil(s) are integrated into the housing of the scanner producing a deactivation field preferably at least partially coextensive with the scan volume of the scanner.

In the device 100, the deactivation unit 150 comprises a central core of magnetically-active material (e.g. iron) with outer wire winding(s) through which current is passed to create the deactivating magnetic field. The housing for the coils can be made of a variety of materials but is preferably injection molded from a non-magnetically active material such as polystyrene or polycarbonate.

Usable with any suitable configuration of the deactivation unit and scanner, following is a description of an operation methodology according to a first preferred embodiment. With current systems, the user is at risk of re-sending product code information (known as a "double read") if the user attempts to retry to deactivate a security device on a deactivator that is integrated or co-located with a scanner. The Sense-Deactivate-Sense (SDS) methodology of this first preferred embodiment provides a way to retry deactivation of the same article without sending multiple indications to the POS. This methodology provides for a secure interlock between a scanner and an EAS controller that assures that a product with a security device will be recognized and deactivated before processing the indicia of the next product.

The basic structure of the Sense-Deactivate-Sense (SDS) methodology requires that a valid barcode (or other indicia) be detected by the scanner, after which the scanner arms an EAS controller (Controller), allowing the EAS security device (Device) deactivation for a pre-determined period of time (Arming Period). Three outcomes are possible while the Controller is armed:

(1) The Controller senses an EAS Device and attempts deactivation. It then attempts to sense the EAS Device again and if it does not, reports Device Detected and Device Deactivated to the scanner. OR (2) The Controller senses an EAS Device and attempts deactivation. It then attempts to sense the EAS Device again and if it does, it continues the deactivate-sense cycle while the arming period lasts until it either succeeds to deactivate, in which case it reports as in (1) above, or fails to deactivate in which case it reports Device Detected and Device not Deactivated to the scanner. OR (3) The Controller attempts to sense an EAS Device for some pre-determined period of time (Detection Period) and fails. It reports Device not Detected and Device not Deactivated to the scanner.

The Controller reports one of the above results to the scanner via a communications channel or channels. In the case of result (1) and (3) the scanner continues normal operation and proceeds to look for the next indicia. If result (2) is reported the scanner alerts the operator to a security exception (Exception).

Exception Processing

In the case of an Exception as stated above, the operator may be alerted that an exception occurred. The operator would then place the scanner into an exception state by activating a switch (button, key switch, foot switch, or an audible-activation switch, etc. such as button 160 on the upper section 140 of FIG. 3), reading indicia, or initiating POS intervention (in EAS aware POS systems). While in the exception state the scanner will arm the controller until the Device is deactivated or the exception state is terminated by the operator. The scanner will optionally provide a visual or auditory indication to the operator while in the exception state. While in the exception state any indicia decoded by the scanner must match the indicia associated with the pre-exception deactivation attempt. Upon termination of the exception state the deactivator is disarmed and a deactivate status can optionally be sent to the POS for logging.

In another exception, if the EAS system fails during a transaction, the operator may be alerted and the operator may deactivate the EAS system to allow for the transaction to be completed.

A preferred methodology will now be described with reference to the flow charts of FIGS. 5 and 6. The normal processing portion 200 (FIG. 5) begins at the barcode scanner, by the steps of:

Step 210—scanning a barcode on an item being passed through a scan volume;

Step 212—processing the barcode and obtaining a valid barcode read;

Step 214—starting the EAS deactivation period timer; typically on the order of about 500 ms, or the timer period may be user programmable as between about 10 ms and 10 seconds.

Step 216—sending an assert deactivation signal to the EAS controller, via arming the EAS controller at Step 218;

Step 220—monitoring the deactivation period timer (which was started at Step 214) and monitoring the communication channel from the EAS controller (from Step 250 described below), and if either (1) the deactivation timer has expired or (2) the deactivation status has been received from the EAS controller, then proceed to Step 222;

Step 222—sending a de-assert deactivation signal to the EAS controller, thus disarming the EAS controller at Step 224.

With the EAS controller being armed at step 218, the EAS controller is operated under the steps of:

Step 240—attempting to sense the presence of an EAS device in the deactivation zone;

Step 242—determining if an EAS device is detected, if "No" return to step 240, if "Yes" proceed to Step 244 (it is noted that the attempt of sensing the EAS tag at Steps 240 and 242 is normally "on" and does not require an activation signal);

Step 244—enabling the deactivation unit if both (1) an EAS device is detected at Step 242 and (2) it is detected per the arm/disarm Step 246 that the arming circuit is armed from Step 218, then proceed to Step 248;

Step 248—determining if the deactivation is still enabled, if "Yes" proceed to Step 252, if "No" (that is, if detected at Step 246 that the arming circuit is disarmed per action of Step 224) then proceed to Step 250;

Step 252—generating a deactivation field, by energizing the deactivation coil(s) for deactivating the EAS device;

Step 254—attempting to sense the presence of an EAS device in the deactivation zone, that is confirming whether or not the EAS tag has been deactivated;

Step 256—if an EAS device is still sensed ("Yes") returning to Step 248 for re-attempting deactivation, and if "No" device is sensed then it is determined that deactivation was successful, and proceeding to Step 250 (alternately, Step 256 may be omitted and the method may proceed directly to Step 250 whether or not the EAS device has been detected);

Step 250—sending deactivation status to the scanner at Step 220 (that is, sending status information as to whether or not an EAS device has been detected and, if detected, whether it has been deactivated);

Step 226—once the deactivation status has been received at Step 222, if an EAS device was detected (per Step 242), proceed to Step 228, if an EAS device was not detected, then proceed to Step 230;

Step 228—determining if the EAS device has been deactivated (per Step 256 indication that the tag previously sensed can no longer be sensed), if "Yes" proceed to Step 230 and if "No" proceed to Step 232; also, optionally if "Yes" that a tag was sensed and deemed to have been deactivated, the system may provide for another announcement such as an audible beep tone (distinct from the frequency of the good read beep tone) thereby notifying the operator that a tag was successfully deactivated.

Figures 6, 6A, 6B, 6C:
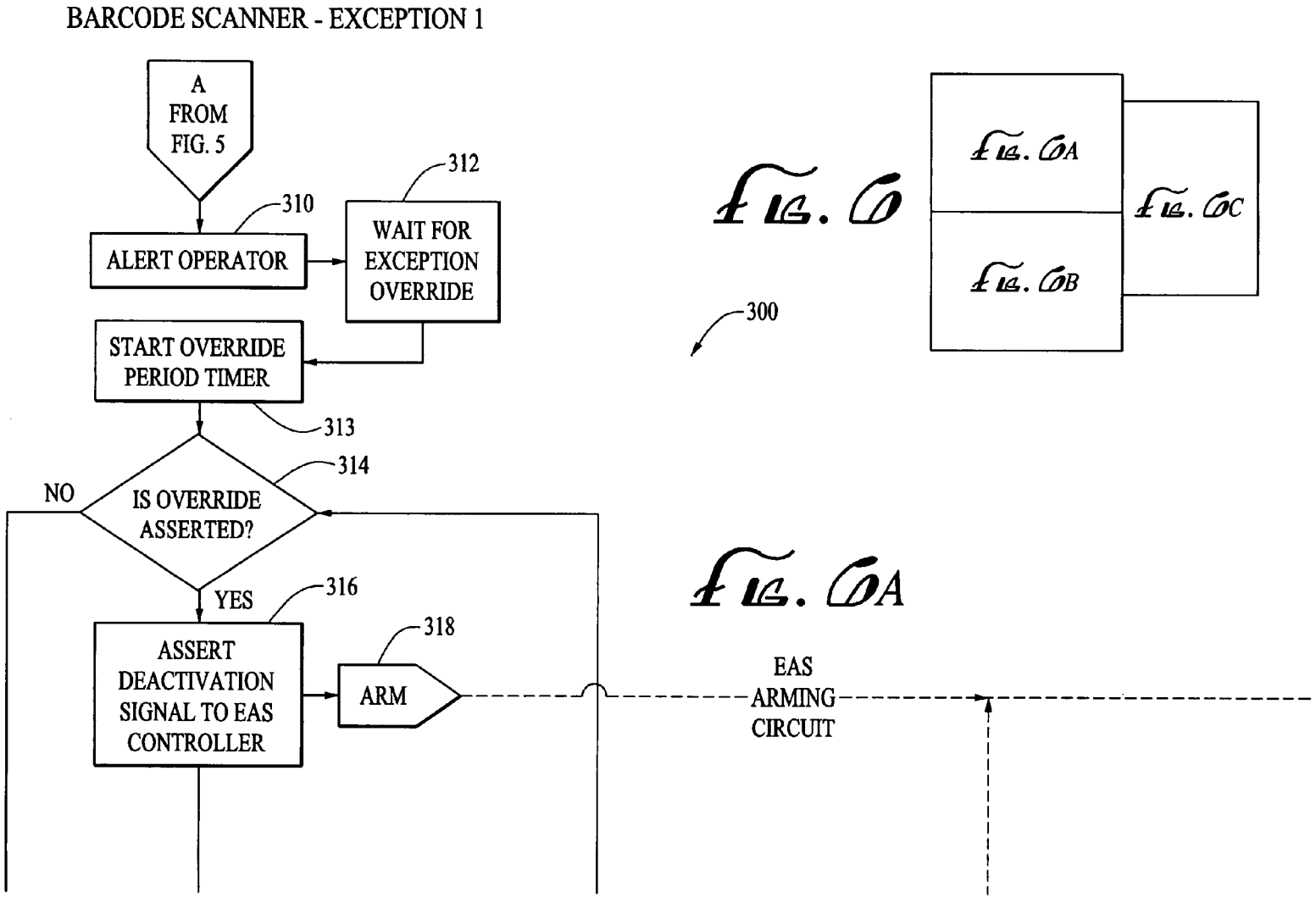
FIG. 6 (comprised of FIGS. 6A, 6B, 6C) are flow charts of a method of scanner and EAS controller operation according to a preferred embodiment.
Figure 6B:
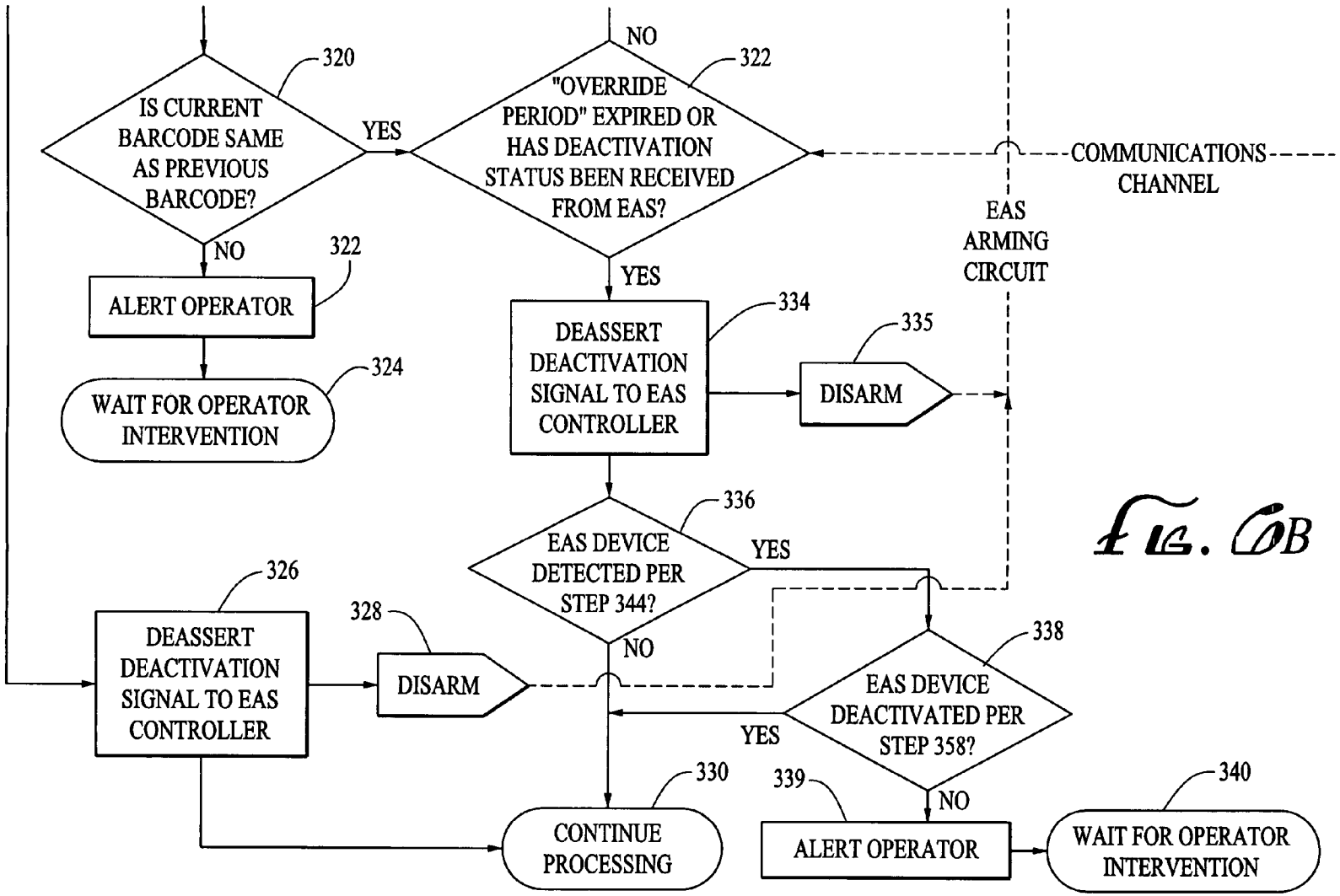
Figure 6C:
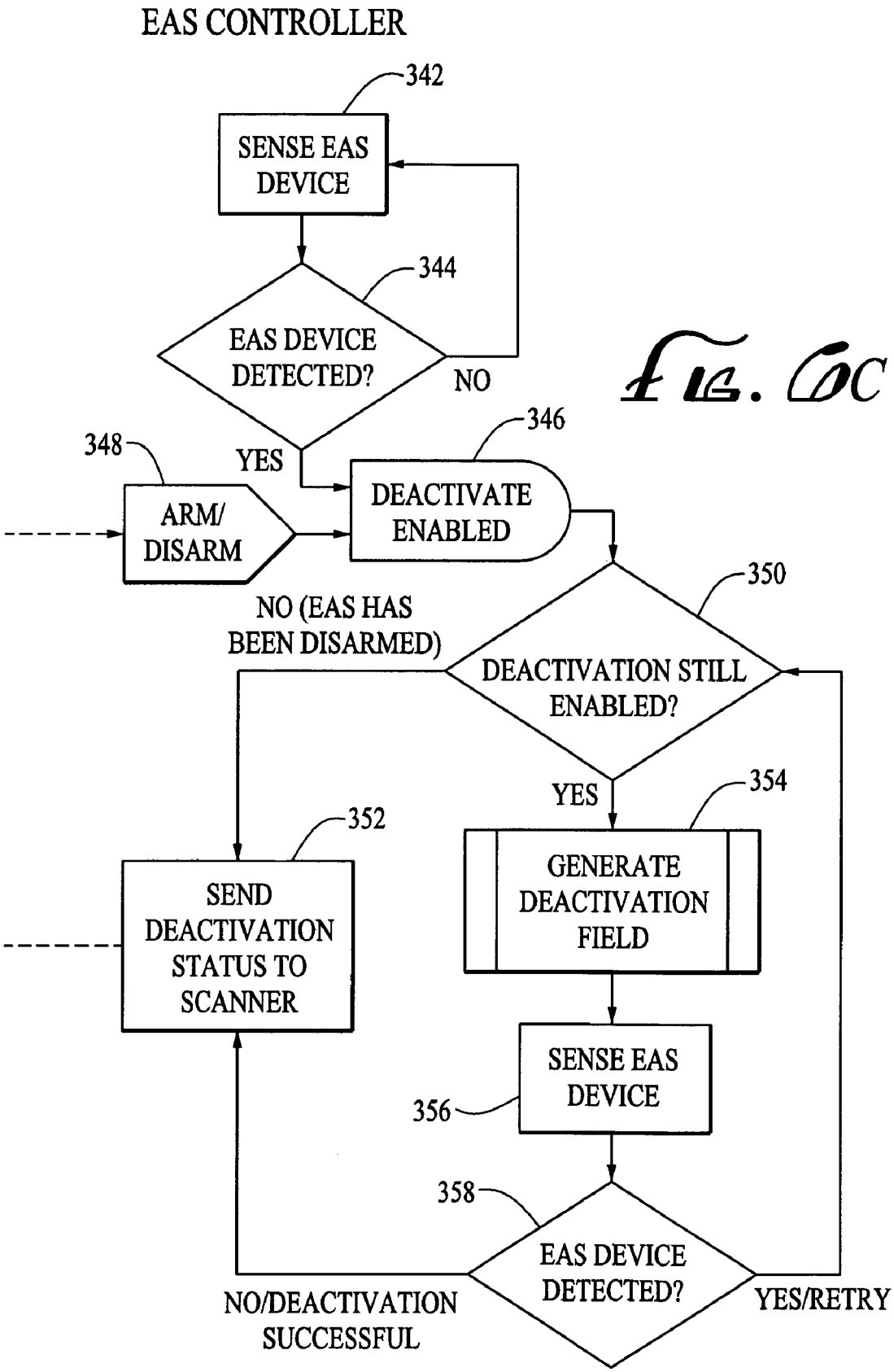

Step 232—signaling "Operator Exception 1" such as by signaling a suitable indicator (visible, audible, vibratory) to the operator and proceeding to the exception methodology 300 of FIG. 6;

Step 230—(upon reaching this step, either the EAS device has been deactivated as decided per Step 228 or the system never sensed an EAS device on the item per Step 226 and assumes that there is no EAS device on the item) proceeding to read the next item in the transaction.

Exception Processing

Figures 5, 5A:
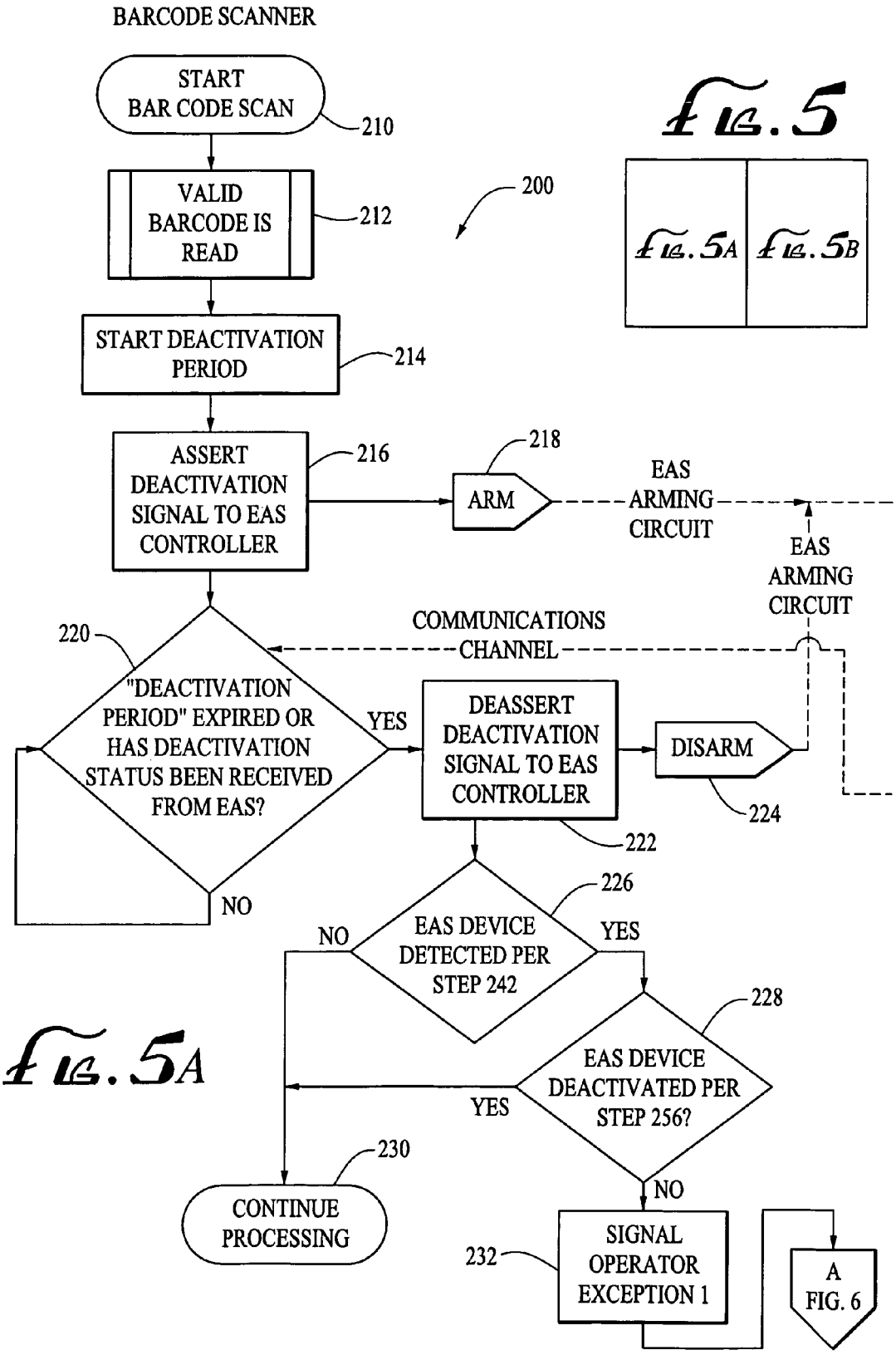
FIG. 5 (comprised of FIGS. 5A, 5B)
Figure 5B:
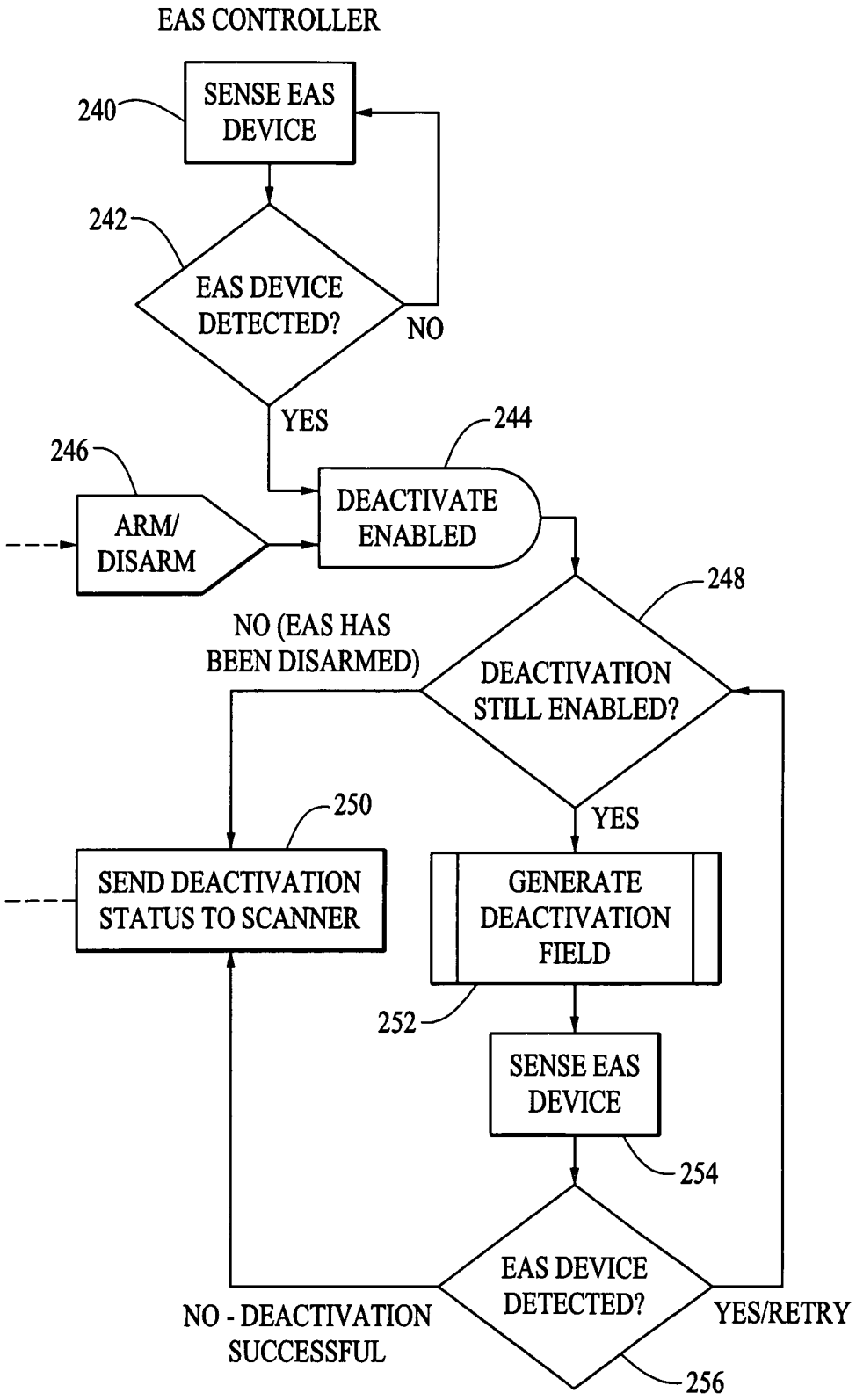

Upon signaling the "Operator Exception 1" at Step 232 of FIG. 5, the method proceeds to the exception methodology 300 of FIG. 6 for handling one of the exceptions, by the steps of:

Step 310—alerting the operator by a suitable indicator (e.g. vibratory, audible, or visible, such as an indicator 162 positioned on the scanner housing illustrated in FIG. 3) that the system has been switched into the "Operator Exception 1" mode of operation;

Step 312—waiting for the operator to engage exception override (such as by actuating switch 160 on the scanner housing 110 of FIG. 3);

Step 313—starting the override period timer;

Step 314—determining if exception override has been asserted, if "Yes" continue to Step 316, if "No" (meaning that the operator has de-asserted the exception override) proceed to Step 326;

Step 326—de-asserting the deactivation signal via disarming EAS control circuit at Step 326, then proceeding to Step 330;

Step 316—sending an assert deactivation signal to the EAS controller, by arming the EAS control circuit at Step 318;

Step 320—reading the barcode on the item in the scan volume, determining whether the current barcode read is the same as the previous barcode and if "Yes" proceed to Step 332, or if "No" proceed to Step 322 (since the item scan volume is at least partially coexistent with the deactivation volume, during deactivation the barcode on the item may be read additional times, a "double read" prevention protocol prevents multiple reads of the same item from being sent to the POS, but this step also provides security from a user attempting to read the barcode on one item but deactivate the EAS device on another item);

Step 322—alerting the operator that the item being read is different from the item previously read in this exception processing procedure;

Step 324—waiting for operator intervention to handle this apparent switching of items according to store policy.

With the EAS control circuit being armed from Step 318, the EAS controller is operated by the steps of:

Step 342—attempting to sense the presence of an EAS device in the deactivation zone;

Step 344—determining if an EAS device is detected, if "No" return to Step 342, if "Yes" proceed to Step 346 (it is noted that the attempt of sensing the EAS tag at Steps 240 and 242 is normally "on" and does not require an activation signal;

Step 346—enabling the deactivation unit upon detecting at Step 348 that the EAS control circuit is armed and an EAS detection confirmation from Step 344;

Step 350—determining if the deactivation is enabled, if "Yes" proceed to Step 354, if "No" (that is if an EAS disarming signal is received or if no device is detected) then it is determined that deactivation is not successful, and proceed to Step 352 determining if the deactivation is still enabled, if "Yes" proceed to Step 354, if "No" (that is, if detected at Step 348 that the EAS arming circuit is disarmed per action of Step 335 or 328);

Step 354—generating deactivation signal (i.e. energizing the deactivation coils);

Step 356—attempting to sense the presence of an EAS device in the deactivation zone;

Step 358—determining if an EAS device is still detected, if "Yes" return to step 350 and retry deactivation, if "No" deactivation is determined to be successful (because the EAS device previously detected at Step 344 is no longer detected) then proceed to Step 352 (alternately, Step 358 may be omitted and the method may proceed directly to Step 352 whether or not the EAS device has been detected);

Step 352—sending deactivation status (that is whether or not an EAS device has been detected at Step 344 and, if detected, whether it has been deactivated per Step 358) to the scanner at Step 332;

Step 334—de-asserting the deactivation signal via disarming EAS arming circuit at Step 335;

Step 336—if an EAS device was detected ("Yes") per Step 344, proceed to Step 338, if an EAS device was not detected ("No"), then proceed to Step 330;

Step 338—determining if the EAS device has been deactivated (per Step 358, if an EAS device is not detected, it is believed that the EAS device previously sensed at Step 344 has been deactivated), if "Yes" proceed to Step 330 and if "No" proceed to Step 339;

Step 339—alerting the operator by a suitable indicator (audible, visible or vibratory) that the EAS device has been detected, but have been unable to deactivate;

Step 340—awaiting operator intervention;

Step 330—upon reaching this step (either from a "No" condition from Step 314, a "No" condition from Step 336, or a "Yes" condition from Step 338) optionally providing an indicator signal (e.g. visual or audible) of successful deactivation and permit continuation of normal processing of a next item in the transaction.

In the various embodiments described above, the data reader unit has been generally described as a barcode scanner, but other types of data readers may be combined with the EAS deactivation/activation system. The data reader may be for example a laser barcode scanner, an imaging reader, an RFID reader, or other type of reader for reading optical codes, reading tags, or otherwise identifying items being passed through a scan/read zone.

The housing 110 of the device of FIGS. 3-4 includes certain indicators and switches that may be employed in the methods described above. On the left side of the upper housing section 140 are arranged a series of switches/indicators. Button 160 is actuated by the operator at Step 312 for engaging exception override. The button 160 may also comprise an indicator, alighting in a certain color when the system has been switched into the "Operator Exception 1" mode of operation per Step 310. Other locations for visual indicators may be employed such as indicator 180 on the platter 130 and switch 170 on the upper right of the upper housing section 140.

In order for a soft EAS tag to be properly deactivated, the tag must remain in the deactivation field long enough for the deactivation field to complete the change in the tag. For example, in one type of EAS tag system, the EAS detection/deactivation system generates a field of RF energy (sense field) that causes an active EAS tag to resonate at a fixed frequency. Detection of this resonate RF signal allows the deactivation system to "sense" the presence of an EAS tag. A de-activated EAS tag is one that no longer resonates at the specified "sense" frequency. Deactivation may be accomplished when the EAS system generates an RF field (deactivation field) of sufficient energy that changes a tag's resonate frequency. Once deactivated, a tag can no longer be sensed by the EAS system.

Particularly where the deactivation system is integrated into a data reader as in many of the preceding embodiments, in order to ensure that a soft EAS tag is properly deactivated, the tag must remain in the deactivation field long enough for the resonant frequency of the tag to change.

In an alternate embodiment, the system delays providing the barcode "good read" indication (typically the audible "beep" tone) when there is evidence that an EAS tag has been sensed. Having not received a "good read" indication, the operator assumes that the barcode label has not yet been read and will continue to hold the item in the vicinity of the barcode scan volume, or alternately pass the item through the scan volume again. Where the scan volume (or the expected item path) coincides with the EAS sense and deactivation volumes, the scanner can continue to check the success of the deactivation by re-sensing the presence of an EAS tag. If a tag is seen after deactivation, the deactivation is tried again. This deactivate-sense sequence is retried for a configurable number of times. If a tag is sensed after every deactivation, it can be assumed that a hard tag is present and the operator can be alerted to correct the condition. Once the scanner starts to retry the deactivation-sense sequence, the retries are attempted for the configurable retry count, regardless of success of the deactivation-sense sequence.

Alternately, the operating technique of the scanner system may be used to enhance likelihood that an EAS tag on an item is deactivated. A preferred method may include the steps of:

(1) The Controller sensing an EAS tag and providing the sense state to the scanner.

(2) If the sense state is true (a tag has been sensed), the scanner starting a pre-read timer.

(3) If the pre-read timer is not running when a barcode is read, asserting the deactivation signal to the Controller for a time period and setting pre-read flag to false and setting the retry flag to false. If the EAS security level is LOW, announcing the barcode read and transmitting the barcode data to the host device.

(4) If a barcode is read by the scanner and pre-read timer is running, asserting the deactivation signal to the Controller for a long time period and setting pre-read flag to true.

(5) If the Controller attempts deactivation during the deactivation time period [step (3) or (4) above], the Controller notifying the scanner, and the scanner de-asserting the deactivation signal to the Controller.

(6) When the Controller notifies the scanner that the sense state is valid, the scanner begins monitoring the sense state from the Controller, the scanner monitoring the sense state until the Controller notifies the scanner that it is ready to deactivate.

(7) If the tag is not sensed during the monitoring period in step (6), providing an indication that the barcode has been read (such as by the scanner emitting an audible "beep") and transmitting the barcode data to the host device.

(8) If during this monitoring period a tag is sensed, setting the retry flag to true and incrementing a sense counter.

(9) For a programmable number of retries, the scanner reasserting the deactivation signal to the Controller for a long time period, the scanner continuing this process from step (5).

(10) After exhausting the retry attempts, if a tag is sensed after every retry attempt the scanner providing notification of a hard tag. That is, that the type of tag that has been sensed could not be deactivated, thus it is presumed to be a non-deactivatable hard tag which must be manually removed from the item by, for example, the store clerk using a suitable removal device.

(11) If the deactivation time period started in steps 3 or 4 expires, the scanner de-asserting the deactivation signal to the Controller.

(12) If the deactivation signal asserted in step 3 or 4 times out and pre-read flag is true then the scanner continuing this process from step (9).

(13) If no retries are attempted or total retries have been tried and the EAS Security level is HIGH, then the scanner indicating a barcode read (e.g. by audibly announcing the barcode by a "beep") and transmitting the barcode to the host device.

It is noted that when the EAS controller sends its sense state to the scanner, the data sense may also include operating condition data indicating the operating status or health of the EAS controller. Thus at initialization or periodically, the scanner monitors the operating health of the EAS controller and alert the operator and/or the POS. For example, if the signal indicated that the deactivator is non-functional, then the scanner may indicate such failure to the operator and shut down scanner operation. In such a system, the user operates through a single interface of the scanner.

Figures 7, 7A:
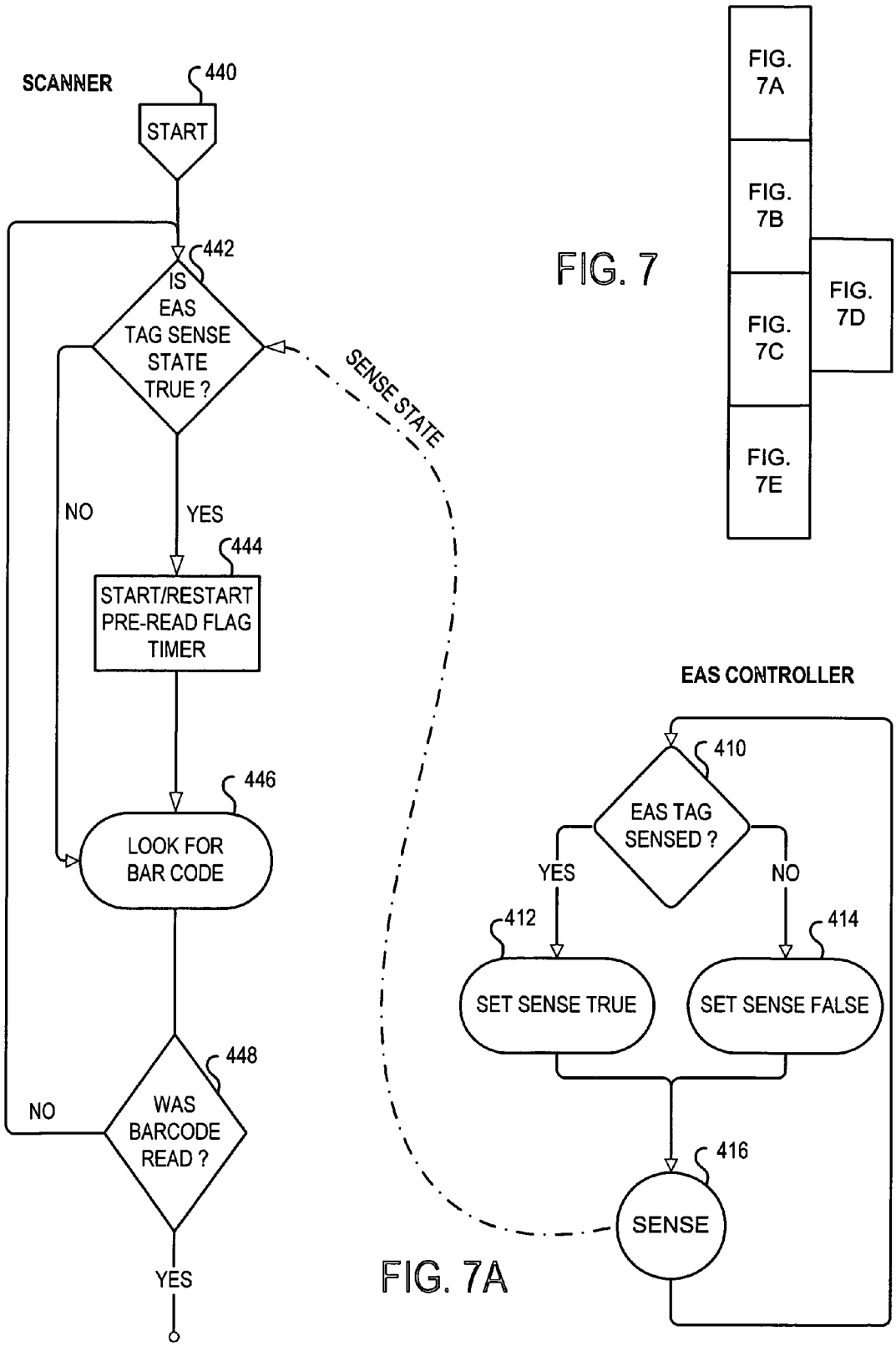
FIG. 7 (comprised of FIGS. 7A, 7B, 7C, 7D, 7E) is a flow chart of another preferred embodiment.
Figure 7B:
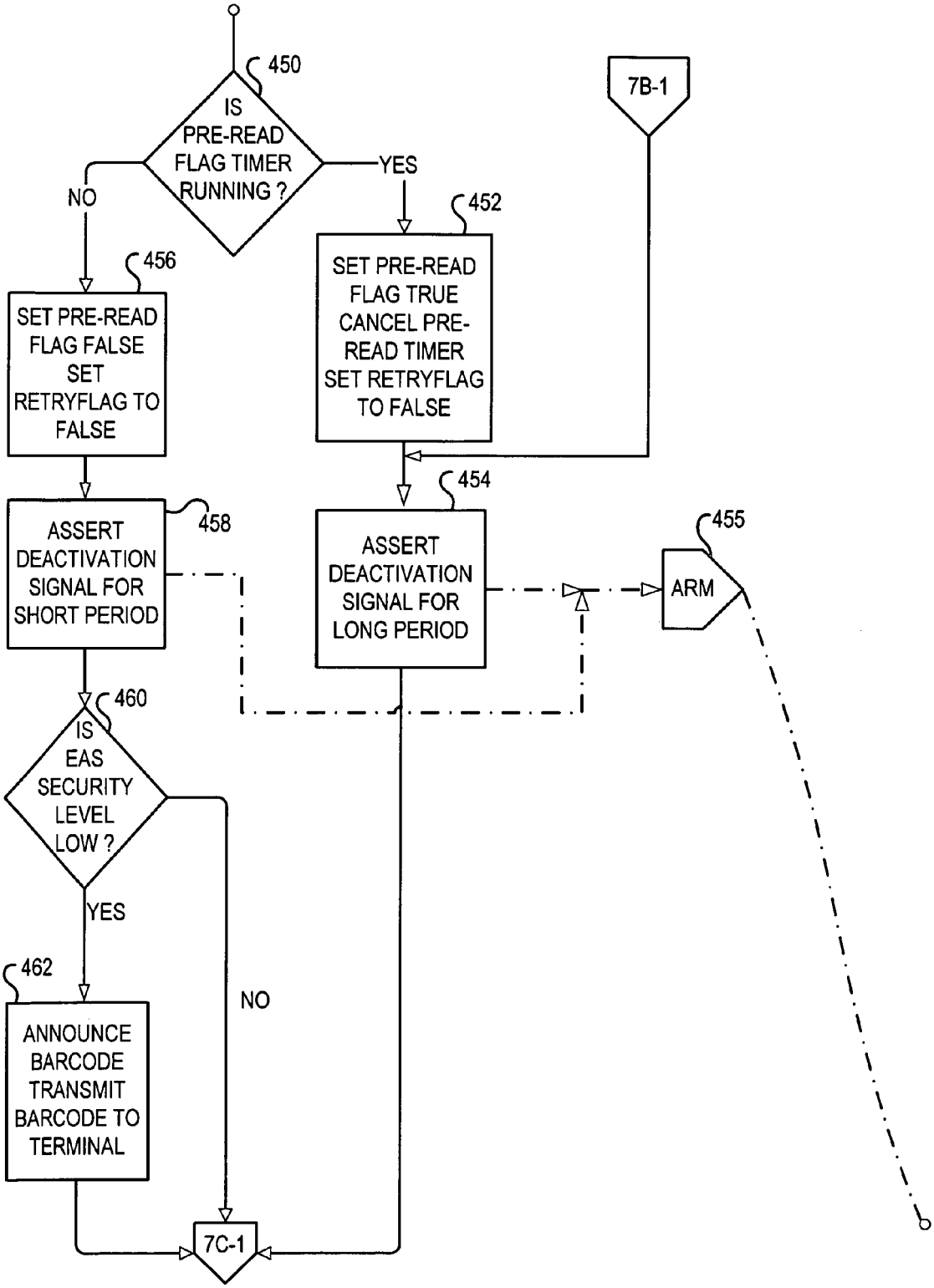
Figure 7C:
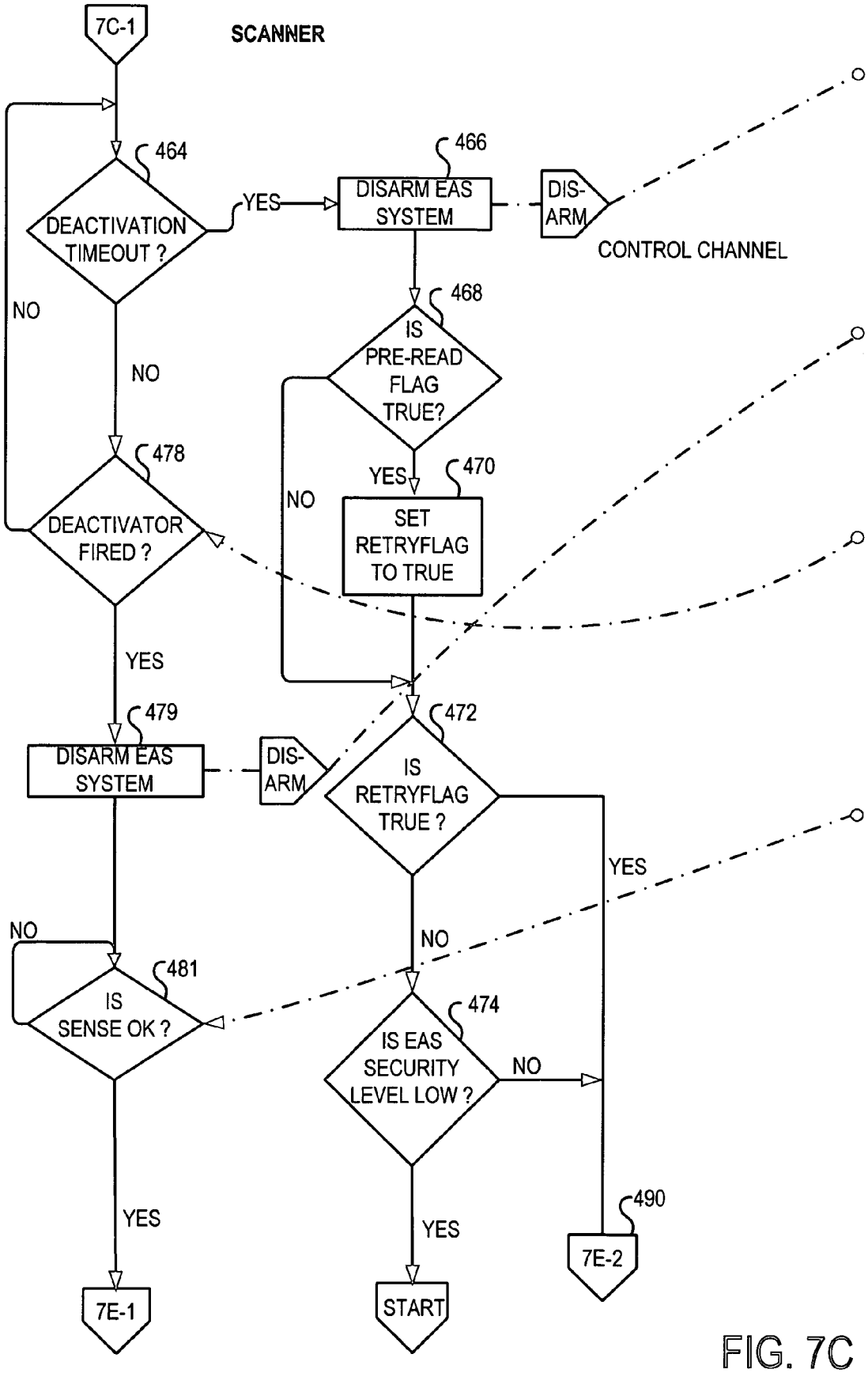
Figure 7D:
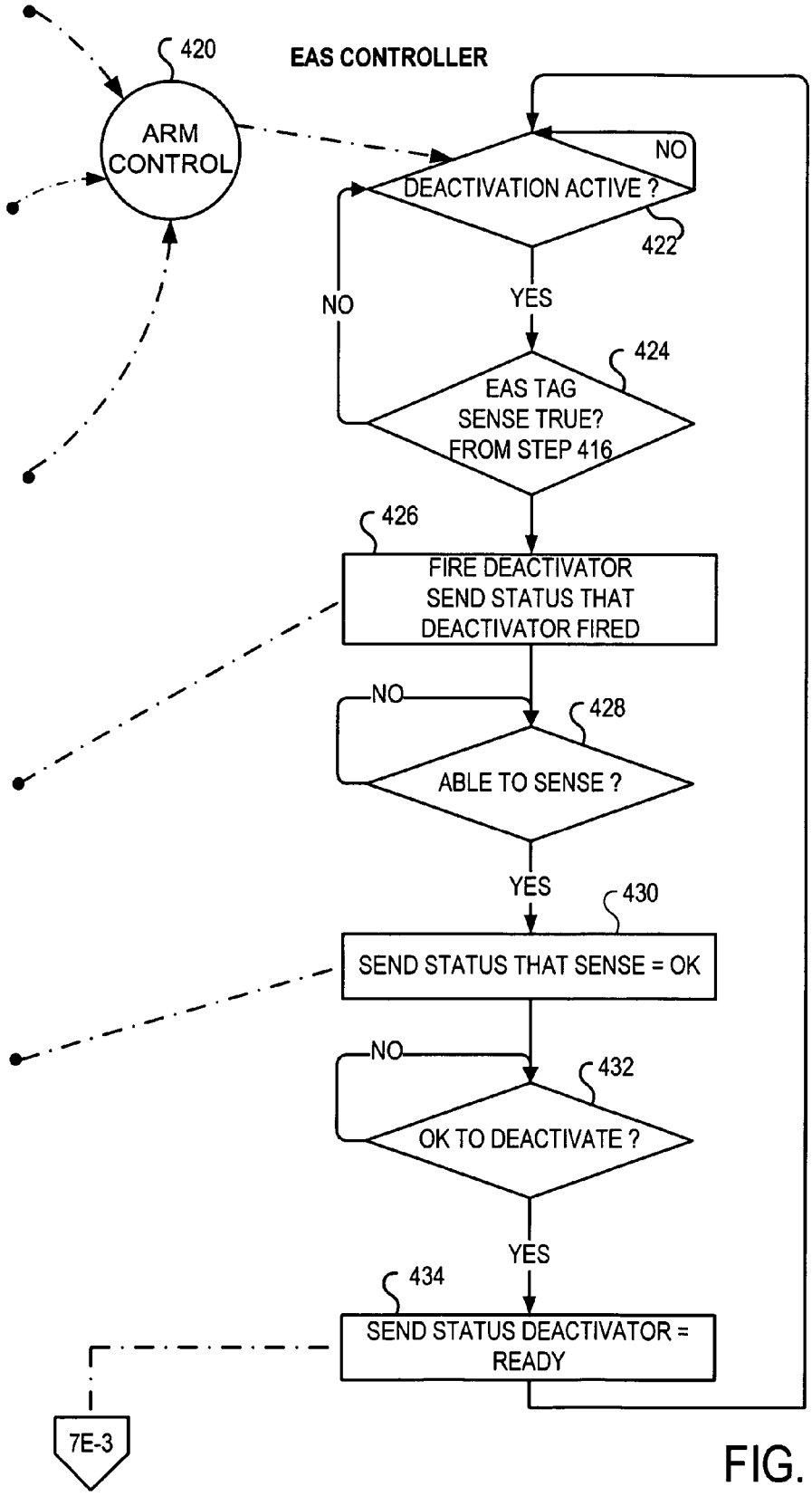
Figure 7E:
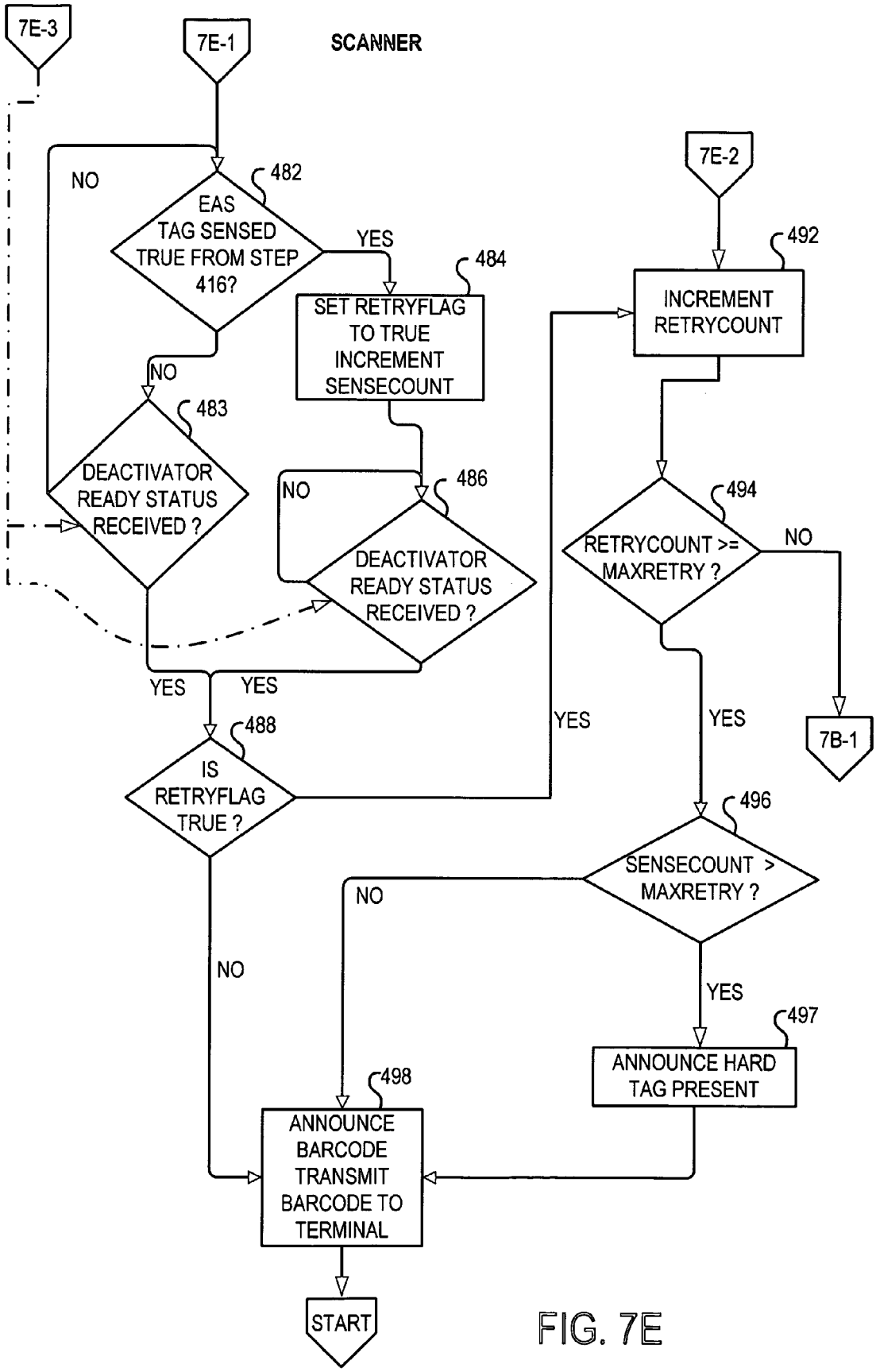

FIG. 7 is a detailed flow chart providing further details of a tag sense and deactivation methodology 400 along the lines of the previously described embodiment, with some variation. By delaying the barcode good read announcement (i.e. the good read "beep") when there is indication that an EAS tag has been sensed, the operator assumes that the barcode label has not been read and will continue to hold the item in the scan volume or otherwise try to pass the item again through the volume. Because the scan volume coincides at least in part with the EAS sense and deactivation volumes, the scanner/deactivator can continue to check the success of the deactivation by re-sensing the presence of the EAS tag. If the tag is sensed after deactivation attempt, deactivation is attempted again. This sense-deactivate-sense sequence may be repeated for a configurable number of times (or for a configurable time period). If a tag is sensed after every deactivation attempt, it may be assumed that a hard tag is present and the operator can be alerted to remove the tag. In one embodiment, once the scanner/deactivator repeats the deactivation-sense sequence, the retries are attempted for the configurable retry count (or time period) regardless of the success of deactivation.

The actual announcing may occur at the scanner itself, which is typical because that is where the scanning of the item takes place, but it may alternately be at the POS terminal or cash register.

As for the delay in the good read announcement, such delay may be implemented in several alternate methods. For example, the system may operate that the good read "beep" is not actuated until (1) the scanner transmits data of a good read to the POS terminal; (2) the POS terminal determines that the barcode data identifies an item in the POS lookup table. The POS may function in combination with the scanner in making the decisions as to delaying announcing the good read. Thus the delaying step may be accomplished by any one or a combination of the following steps:

Where the scanner is making the good read determination, the scanner delaying directly announcing the good read (i.e. "beep") to allow for confirmation of EAS deactivation.

Where the scanner transmits data to the POS (in either coded or undecoded form), the scanner requiring confirmation from the POS prior to announcing the good read (i.e. "beep"), the scanner delaying transmitting of good read data to the POS to allow for confirmation of EAS deactivation.

Where the scanner transmits data to the POS (in either coded or undecoded form), the scanner requiring confirmation from the POS prior to announcing the good read (i.e. "beep"), the POS delaying transmitting back to the scanner confirmation of the good read to allow for confirmation of EAS deactivation.

Referring to FIG. 7, the process 400 begins at the EAS controller sensing side of the system, where the EAS sensor is continuously attempting to sense an EAS tag by the steps of:

Step 410—attempting to sense an EAS tag and determining if an EAS device is detected, if "Yes" proceed to Step 412, if "No" proceed to Step 414 (it is noted that the attempt of sensing the EAS tag at Step 410 is normally "on" and does not require an activation signal).

Step 412—setting the Sense variable to TRUE (indicating that an EAS tag was sensed at Step 410) then returning to Step 410 via the sense indicator 416.

Step 414—setting the Sense variable to FALSE (indicating that an EAS tag was not sensed at Step 410) then returning to Step 410 via the sense indicator 416.

The sense flag or indicator 416 provides for connection between the EAS controller side of the system and the scanner side of the system. As will be described below, the scanner at Step 442 will be able to receive indication from the flag 416 of the sense state, that is whether the sense state is set to TRUE or FALSE.

When the system is on, the EAS controller cycles through the tag sensing state at a speed of about ten millisecond (10 ms) per cycle. Thus the sense state at the flag 416 will change rapidly depending upon whether an EAS tag was sensed on a given cycle. The cycle speed may be selected based upon system design requirements or other criteria.

Turning to the scanner side, the scanner commences at start Step 440 either on power-up, re-awakening from sleep mode or otherwise being in an "ON" mode, and proceeds according to the following steps:

Step 442—determining whether the EAS tag sense is set to TRUE or FALSE; if set to TRUE ("Yes"), proceeding to Step 444 and if not set to True ("No") skipping Step 444 and proceeding directly to Step 446.

Step 444—starting/restarting pre-read flag timer. The pre-read timer is a countdown timer which counts down a period of time within which certain barcode reading activities are to take place as described below. The countdown time may be a fixed amount (e.g. preset at time of manufacture) or programmable (e.g. set by the user or the store technician). The pre-read timer is typically set in a range of about 0.5 to 2.5 seconds. After the pre-read timer is started/restarted, the system proceeds to Step 446.

Step 446—looking for a barcode. The scanner seeks and attempts to find a barcode in its scan region.

Step 448—determining if a valid barcode has been read: if "No" returning to Step 442 and if "Yes" proceeding to Step 450.

It is worthwhile to note that the time for the system cycling through Steps 442 through 448 can vary depending upon system design, or may be set by the manufacturer, or may be a variable as set by the user or system technician. In one embodiment, the cycle speed of the scanner is about five millisecond (5 ms). This cycle speed is about twice the cycle speed of the EAS controller cycle—2× oversampling. Thus the scanner is checking for the most recent sense state for the EAS controller. Moreover, the system may also detect a transition signal within the sense state received from the flag 416. For example, if the flag is in the process of changing from "True" to "False", that occurrence would more likely be an indication that an EAS tag is in the region. The system may thus consider a transition signal to be a "True" signal.

Step 450—if a barcode is read "YES" at step 448, determining if the pre-read timer is still running: if "Yes" proceed to Step 454, if "No" proceed to Step 452.

Step 452—if "YES" from Step 450, setting the pre-read flag to TRUE (meaning that the tag was detected before the barcode was read within the pre-read flag timer), canceling the pre-read timer (setting the flag timer to zero), and setting the retry timer to false (initializing the retry timer).

Step 454—asserting EAS deactivation signal for LONG period by sending an arming signal via 455 to the EAS arming control 418, then proceeding to Step 464. The LONG period allows for a longer period of arming the deactivator (relative to the SHORT period of Step 458) in the condition that a tag is believed more likely to be present.

Step 456—if "NO" from Step 450, setting pre-read flag to FALSE (meaning that a tag was not detected during the pre-read flag timer period) and setting retry flag to FALSE (initializing the retry flag to false); then proceeding to Step 458.

Step 458—asserting EAS deactivation signal for SHORT period (short arming period relative to LONG period); by sending an arming signal via 455 to the EAS arming control 418, then proceeding to Step 460.

The time that the EAS controller can deactivate (ARM time) is extended during the LONG period (Step 454) to allow for greater certainty of deactivation for items with tags. The SHORT period (Step 458) is used primarily to maximize item throughput (i.e., minimize average item time) for items without EAS tags. The LONG and SHORT periods may be either preset or customer configurable depending upon customer preference relating to a balance as between throughput speed and security. For example the SHORT period is typically on the order of about 500-1000 ms, and the LONG period is typically on the order of 3-5 seconds. These timer periods may be user programmable as between about 10 ms and 10 seconds.

These arming timers may be coordinated with other timers used in the decoding system. For example, in a decoding system where a timer is set to prevent multiple reads of the same item/barcode, that timer may be used to extend the ARM time to prevent premature expiration/termination of the arming period. Use of this decode timer may be particularly useful where the scan volume is not co-extensive with either the EAS sensing volume or the EAS deactivation volume.

Step 460—determining if EAS security level is LOW; if "NO" skip step 462 and proceed to Step 464; if "YES" proceed to Step 462.

This EAS security level setting may be another user configurable parameter allowing the user to choose security level depending upon customer preference relating to the balance as between throughput speed and security. A "LOW" security level is selected if faster throughput speed is preferred; a "HIGH" security level is selected if higher security is preferred.

Step 462—announcing barcode "good read" indication (typically the audible "beep" tone) and transmitting barcode data to the terminal. Thus at LOW security level, a good barcode read is acknowledged immediately after decoding, thereby enhancing throughput speed.

Step 464—following Step 462 or 454, determining whether the deactivation signal (which had been asserted in Step 458 or Step 454) has timed out; if "YES" proceed to Step 466, if "NO" proceed to Step 478.

Step 466—disarming EAS system (i.e. by sending a deassert deactivation signal to the EAS arm controller 420 via disarm controller signaler 467).

Steps 468, 470—determining whether pre-read flag (from Steps 452 and 456) is TRUE or FALSE; if pre-read flag is TRUE proceed to Step 470 and set RetryFlag to TRUE then proceed to Step 472; if pre-read flag is FALSE, skip Step 470 and proceed directly to Step 472.

Step 472—determining whether RetryFlag is set to TRUE or FALSE; if TRUE proceed to Step 482, if FALSE proceed to Step 474.

Step 474—determining if EAS security level is set to LOW (this setting is a user-configurable setting as described above); if "NO" proceeding to Step 482, if "YES" proceeding back to Start Step 440.

Returning to the EAS Controller, the controller includes an arming control 420 for receiving the arming/disarming signals from the scanner. The EAS deactivation sequence is operated by the steps of Step 422—determining whether the deactivator is active, i.e. whether it has received an arming signal from the controller 420; if "NO" cycling back and checking again, if "YES" proceeding to Step 424.

Step 424—determining whether EAS tag has been sensed at Step 410 (i.e. from sense state 416 whether Set Sense=TRUE); if "NO" returning to Step 422, if "YES" passing to Step 426.

Step 426—firing deactivator (activating deactivator coil 14 from FIG. 1) and sending status that the deactivator has been fired.

Step 428—determining whether the system is ready to sense for an EAS tag; if "NO" cycling/repeating this Step 428, if "YES" passing to Step 430. When the deactivator 12 fires, the deactivator coil 14 generates a large magnetic field pulse for attempting to deactivate the EAS tag which has been sensed. This magnetic pulse is electromagnetically disruptive and takes a discrete amount of time to dissipate sufficiently that the EAS sensing at Step 410 is effective/reliable. This status check will allow for the system to delay attempting to sense during this period that the magnetic pulse is dissipating.

Step 430—Sending status that sensing system is operational again after deactivation pulse (Sense=OK).

Step 432—determining whether the deactivator is ready for deactivation; if "NO" cycling/repeating this step, if "YES" passing to Step 434.

Step 434—sending status that the deactivator is ready (Deactivator=READY). After the deactivator has fired, it takes a certain amount of time for the deactivator to recharge and be enabled to fire a new pulse. Steps 432 and 434 provide a status check to ensure that the deactivator has been recharged.

Returning to the scanner operation:

Step 478—determining if the deactivator has been fired; if "NO" returning to Step 464, if "YES" proceeding to Step 479.

Step 479—disarming the EAS system (i.e. sending a deassert deactivation signal to the EAS arm controller 420 via a disarm controller signaler 480). It is noted that the deactivator fired status in the arm control 420 is reset by disarming.

Step 481—determining if it is ok to sense (i.e., that the signal has been received from EAS controller Step 430 that the magnetic field pulse has sufficiently dissipated); if "NO" cycle and repeat Step 481, if "YES" proceed to Step 482.

Step 482—determining whether an EAS tag was sensed from Step 416; if "YES" proceeding to Step 484, if "NO" passing to Step 483.

Step 483—determining whether ready status was received (Deactivator=ready from Step 434); if "NO" cycling back to Step 482, if "YES" proceeding to Step 488.

Step 484—(from "YES" decision in Step 482) setting RetryFlag to TRUE and incrementing SenseCount. SenseCount is a variable counting the occurrences each time an EAS tag is sensed.

Step 486—determining whether ready status was received (Deactivator=Ready from Step 434); if "NO" cycling this Step 486, if "YES" proceeding to Step 488.

Step 488—determining whether RetryFlag is TRUE; if "NO" proceeding to Step 498, if "YES" passing to Step 492.

Step 492—incrementing the RetryCount, then passing to Step 494. The RetryCount is the number of unsuccessful deactivation attempts (i.e., the number of times the deactivator has been fired in an attempt to deactivate a sensed EAS tag) whereby the EAS tag is nonetheless still sensed after the deactivation attempt.

Step 494—determining whether SenseCount is greater than or equal to MaxRetry; if "NO" pass to Step 498, if "YES" proceed to Step 497.

Step 497—announcing that a hard tag is present. Such announcing may be accomplished by sounding a certain audible tone, preferably distinct from the good barcode read "beep" tone of the scanner and/or visual indication to the operator such as an exception light 180 on the scanner 100. If a tag is continued to be sensed after the MaxRetry number of attempts to deactivate, it is presumed that the tag is a non-deactivatable hard tag that must be manually removed from the item by, for example, the store clerk.

Step 498—announcing a good read, and transmitting the barcode data to the terminal or host (such as the POS terminal); then returning to the start Step 440 for the next item read. Such announcing may comprise the typical good barcode read "beep" tone of the scanner.

The above methods/systems may provide one or more of the following advantages:

- Providing audible and/or visual cue(s) to the operator to enable the operator to return or keep the EAS tag in the deactivation field for a sufficient time enhancing the probability of proper deactivation.
- Providing audible and/or visual cue(s) to the operator to enable the operator to return or keep the EAS tag in the sensing field for a sufficient time to ensure verification that an EAS tag has been properly deactivated.
- Providing audible and/or visual cue(s) to the operator for indicating that a hard tag has been detected.
- Minimizing occurrences of a failure to deactivate, that is by enhancing likelihood that if the item contains a tag that it will be detected and either deactivated or, if not deactivated, the operator is notified to correct the situation.

Though certain of the preferred embodiments have described systems and methods by which the scanner subsystem and EAS controller subsystem operate along parallel processing paths, the system may comprise varying levels of integration. For example, the subsystems may be operated by separate processors with the subsystems communicating only along the various communication paths shown in the various flow charts. Alternately, the system may be constructed with a higher level of integration whereby the subsystems share the same processor and/or other electronics. In such a more integrated system, the communication paths may be internal or even deemed eliminated.

Though the preferred embodiments have been primarily described with respect to sensing and deactivating EAS tags, it would be understood that the systems and methods described herein may apply to other types of electronic tags such as RFID tags or security electronics incorporated into the electronics of a product itself, such as disclosed in U.S. patent application Ser. No. 09/597,340 hereby incorporated by reference.

Though the embodiments have been described primarily with respect to barcode readers, it is understood that they may comprise other types of data readers such as readers for reading other types of identification code labels (e.g. 1-D, 2-D, PDF-417), RFID tags, imaging readers such as have been suggested for identifying items based on their physical images such as for identifying produce. The readers may also comprise hybrid combination readers that read multiple types of tags. Thus for purposes of this disclosure, an ID tag is defined as any suitable device that contains data which may be obtained by a reader. Suitable ID tags include, but are not limited to: optical code labels or tags, electronic tags such as RFID tags, or the like.

Thus the present invention has been set forth in the form of its preferred embodiments. It is nevertheless intended that modifications to the disclosed systems may be made by those skilled in the art without altering the essential inventive concepts set forth herein.

The invention claimed is:

1. A combined security tag unit and data reader system comprising:

a security tag deactivation unit arranged for deactivating an electronic security tag located proximate to the read volume of the data reader; and a data reader for reading an ID tag, wherein the data reader is operative to undergo a change in operation in response to input from the security tag deactivation unit.

2. A system according to claim 1 wherein the change in operation of the data reader comprises a delay in the data reader indicating a successful read of an ID tag in response to input from the security tag deactivation unit that an electronic security tag has been re-sensed after an attempt to deactivate.

3. A system according to claim 1 wherein the data reader is operative for arming the security tag deactivation unit upon a successful read of the ID tag.

4. A system according to claim 1 wherein the security tag deactivation unit comprises an EAS controller and an EAS deactivation device.

5. A system according to claim 1 wherein the data reader in configured to indicate a successful read of the ID tag only after both successful read of the ID tag and successful deactivation of the security tag have occurred, thereby avoiding multiple indications of the read of the same ID tag.

6. A system according to claim 1 wherein the ID tag and the electronic security tag are both contained within a single tag.

7. A system according to claim 6 wherein the single tag comprises a multiple function RFID tag.

8. A method of operating a system for reading ID tags and deactivating electronic security tags, comprised of a security tag deactivation unit and a data reader, the method comprising the steps of:

sensing to detect presence of an electronic security tag on an item proximate to a read volume of the data reader;

reading data from an ID tag on the item;

if an electronic security tag has been detected, attempting to deactivate the electronic security tag;

adjusting operation of the data reader in response to input from the security tag deactivation unit.

9. A method according to claim 8 further comprising after attempting to deactivate, attempting to re-sense the a security tag.

10. A method according to claim 9 wherein the step of adjusting operation of the data reader in response to input from the security tag deactivation unit comprises if the security tag is re-sensed, (1) providing a visual or audio cue to an operator to return the item to the read volume and (2) re-attempting to deactivate the electronic security tag.

11. A method according to claim 10 further comprising notifying the operator of a failure to deactivate if repeated re-attempting to deactivate the electronic security tag.

12. A method according to claim 8 wherein the step of sensing to detect presence of an electronic security tag occurs at any one or more of the following times:

at the same time as the step of reading data from an ID tag, and prior to the step of reading data from an ID tag.

13. A system according to claim 8 wherein the data reader is operative for arming the EAS controller upon a successful read of the ID tag.

14. A method of operating and controlling a system having a data reader defining a read volume and an associated security tag deactivation unit, for reading an ID tag and deactivating an electronic security tag on an item, the method comprising the steps of:

reading data from an ID tag located within the read volume of the data reader;

sensing for an electronic security tag;

if an electronic security tag is sensed, the security tag deactivation unit attempting to deactivate the electronic security tag, wherein operation of the data reader is adjusted based on input from the security tag deactivation unit.

15. A method according to claim 14 wherein the security tag deactivation unit attempts to deactivate only if an ID tag is read within a predetermined time window proximate to the electronic security tag being sensed.

16. A method according to claim 14 further comprising after attempting to deactivate, attempting to re-sense the a electronic security tag.

17. A method according to claim 16 further comprising if the security tag is re-sensed, (1) providing a visual or audio cue to an operator to return the item to the read volume and (2) re-attempting to deactivate the electronic security tag.

18. A method according to claim 14 wherein operation of the data reader is adjusted by delaying acknowledgment of the data read from the data reader.

19. A method according to claim 14 further comprising attempting to deactivate a security tag only after data from an ID tag has been successfully read.

20. A method of operating a Point of Sale (POS) system having a data reader defining a read volume and an associated security tag deactivation unit, the method comprising the steps of:

the data reader reading data from an ID tag on an item located within the read volume;

the security tag deactivation unit sensing for an electronic security tag;

notifying the POS system of sensing results from the security tag deactivation unit.

21. A method according to claim 20 further comprising the POS delaying transmitting back to the data reader confirmation of a good read depending upon sensing results received from the security tag deactivation unit.

22. A method according to claim 20 further comprising the POS logging deactivation results received from the security tag deactivation unit.

* * * * *

UNITED STATES PATENT AND TRADEMARK OFFICE

CERTIFICATE OF CORRECTION

PATENT NO. : 7,495,564 B2
APPLICATION NO. : 11/699207
DATED : February 24, 2009
INVENTOR(S) : Clifford et al.

It is certified that error appears in the above-identified patent and that said Letters Patent is hereby corrected as shown below:

On the Title Page
Item (12), in the header, change "Harold et al." to --Clifford et al.--.
Item (75), under "Inventors" change "Clifford C. Harold" to --Harold C. Clifford--.

Column 9
Line 65, change "steps 3 or 4" to --step 3 or 4--.

Column 10
Line 14, change "alert" to --alerts--.

Signed and Sealed this

Fourth Day of August, 2009

JOHN DOLL
*Acting Director of the United States Patent and Trademark Office*